US007735346B2

(12) United States Patent
Ha et al.

(10) Patent No.: US 7,735,346 B2
(45) Date of Patent: Jun. 15, 2010

(54) DOOR OF DRUM-TYPE WASHING MACHINE, AND METHOD OF MANUFACTURING DOOR WITH DECORATIVE PORTION THEREOF

(75) Inventors: Young Hoon Ha, Kyungsangnam-do (KR); Bo Yoen Kim, Kyungsangnam-do (KR); Jong Seog Gim, Kyungsangnam-do (KR); Ji Chang Son, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 822 days.

(21) Appl. No.: 10/992,673

(22) Filed: Nov. 22, 2004

(65) Prior Publication Data

US 2005/0138974 A1 Jun. 30, 2005

(30) Foreign Application Priority Data

Dec. 30, 2003 (KR) ..... 10-2003-0100251
Dec. 30, 2003 (KR) ..... 10-2003-0100252
Dec. 30, 2003 (KR) ..... 10-2003-0100253
Dec. 30, 2003 (KR) ..... 10-2003-0100254
Dec. 30, 2003 (KR) ..... 10-2003-0100255

(51) Int. Cl.
*D06F 37/28* (2006.01)

(52) U.S. Cl. ..... 68/196

(58) Field of Classification Search ..... 68/23 R, 68/24, 140, 196
See application file for complete search history.

(56) References Cited

U.S. PATENT DOCUMENTS 2,105,248 A 1/1938 Johnson
2,204,551 A 6/1940 Place
2,317,213 A * 4/1943 Oliver ..... 220/849
2,843,945 A * 7/1958 Whyte ..... 34/82
2,861,355 A 11/1958 Douglas
3,069,887 A 12/1962 Gould
3,139,784 A 7/1964 Moorman
3,370,738 A 2/1968 Kesling
4,564,557 A * 1/1986 Ohgushi et al. ..... 428/333
4,665,654 A 5/1987 Stedron et al.
5,496,104 A * 3/1996 Arnold et al. ..... 312/204

(Continued)

FOREIGN PATENT DOCUMENTS

DE 195 15 040 A1 10/1996

(Continued)

*Primary Examiner*—Joseph L Perrin
(74) *Attorney, Agent, or Firm*—Birch, Stewart, Kolasch & Birch, LLP

(57) ABSTRACT

A door of a drum-type washing machine, a method of manufacturing a door having hairlines for the drum-type washing machine, and a method of manufacturing a hairline sheet for the door are disclosed herein. The door of the drum-type washing machine comprises a door frame hingeably provided to a front surface of the drum-type washing machine, and a door glass provided to a central hole opened through the door frame. The door frame is provided on the front surface thereof with a multiple ring-shaped hairline sheet. The door frame is reinforced by means of the hairline sheet, and enhanced in an overall aesthetic appearance of the door. The hairline sheet can be conveniently replaced with a new one, if necessary, so that, when the surface of the door is severely damaged or contaminated, these can be overcome by replacing the damaged or contaminated hairline sheet with the new one.

5 Claims, 12 Drawing Sheets

U.S. PATENT DOCUMENTS

| | | | | |
|---|---|---|---|---|
| 6,278,448 | B1 | 8/2001 | Brown et al. | |
| 6,736,470 | B2 | 5/2004 | Manke et al. | |
| 6,840,773 | B2 | 1/2005 | Anderson et al. | |
| D515,260 | S * | 2/2006 | Ha et al. | D32/25 |
| 7,299,666 | B2 * | 11/2007 | Geyer et al. | 68/140 |

FOREIGN PATENT DOCUMENTS

| | | | |
|---|---|---|---|
| EP | 1 291 459 | B1 | 5/2006 |
| GB | 2 114 432 | A | 8/1983 |
| JP | 04-174152 | A | 6/1992 |
| JP | 08-281429 | A | 10/1996 |
| JP | 11-244575 | A | 9/1999 |
| JP | 11-300888 | A | 11/1999 |
| JP | 2001-207648 | A | 8/2001 |
| JP | 2001-277290 | | 10/2001 |
| JP | 2002-010892 | | 1/2002 |
| JP | 2002-098776 | | 4/2002 |
| JP | 2003-175298 | | 6/2003 |
| JP | 2003-291261 | A | 10/2003 |
| JP | 2004-224945 | A | 8/2004 |
| WO | WO 0214593 | A2 * | 2/2002 |

* cited by examiner

DOOR OF DRUM-TYPE WASHING MACHINE, AND METHOD OF MANUFACTURING DOOR WITH DECORATIVE PORTION THEREOF

BACKGROUND OF THE INVENTION

1. Field of the Invention

The present invention relates to a door of a drum-type washing machine, and more particularly, to a door of a drum-type washing machine, which has a front member on a front surface of the door to reinforce the door, and has a decorative portion formed on the front member to enhance an aesthetic appearance of the washing machine, and a method of manufacturing a door having a decorative portion thereof.

2. Description of the Related Art

Generally, washing machines are used for removing dirt and strains from clothes by virtue of a mechanical operation of the washing machines. Among the washing machines, a drum-type washing machine washes laundry by means of friction between a drum, horizontally installed in the washing machine to be rotated by a driving force of a motor, and the laundry contained together with wash water and detergent in the drum. The drum-type washing machine has advantageous effects of substantially preventing the laundry from being damaged and entangled with each other, and of washing the laundry by way of pounding and rubbing the items of the laundry with each other.

FIG. 1 is a perspective view illustrating a conventional drum-type washing machine, FIG. 2 is a section side elevation illustrating the conventional drum-type washing machine, and FIG. 3 is a cross-sectional view taken along line A-A of FIG. 2.

As shown in FIGS. 1 and 2, the conventional drum-type washing machine comprises a cabinet 2 defining an outer appearance of the washing machine, a tub 4 suspended by means of a spring 3 inside the cabinet 2, a drum 5 installed in the tub 4 to wash laundry therein, a lifter 6 formed on an inner surface of the drum 5 to raise the laundry to a predetermined height and then to allow the laundry to fall from the predetermined height due to gravity, a motor 7 mounted at a rear side of the tub 4 to generate power, a cabinet cover 22 attached at a front surface of the cabinet 2 and having a laundry entrance 24 formed through the cover 22 to allow the laundry to be input or output therethrough, and a door 20 provided to the cabinet cover 22 to open or close the laundry entrance 24, thereby preventing the laundry from exiting from the laundry entrance 24.

Here, a gasket 8 is provided between the tub 4 and the door 20, and functions as a packing member to relieve an impact resulting from rotation of the drum 5 while preventing water from overflowing to the outside of the washing machine.

Additionally, the washing machine is provided at an upper portion thereof with a top plate 9 to form an upper surface of the washing machine, and at a lower portion thereof with a base 10 to form a bottom surface of the washing machine. A drainage pump 11 and a drainage hose 12 are provided beneath the tub 4 to both circulate and discharge wash water, respectively. A water supply hose 13, a water supply valve 14, and a detergent barrel 15 are embedded beneath the top plate 9 to feed the water and the detergent into the tub 4.

Moreover, as shown in FIG. 3, the door 20 of the conventional drum-type washing machine comprises a ring-shaped door frame 30 hingeably provided to the cabinet cover 22, a door hinge 40 having both ends respectively connected to the door frame 30 and the cabinet cover 22 to hingeably support the door frame 30, and a door glass 50 installed at a central hole 30*a* opened through the door frame 30 to allow an inner circumstance of the drum 5 to be observed therethrough.

The door frame 30 is generally formed of a plastic material by means of injection molding. The door frame 30 comprises a front door frame 32 provided at the front surface of the washing machine and having a grip 36 formed at one side of the door frame 30, and a rear door frame 34 provided at the rear side of the front door frame 32 and having one end of the door hinge 40 connected to the rear door frame 34. The rear door frame 34 has at least one hook 37 protruded at one side thereof, and the cabinet cover 22 has at least one hook hole 38 formed through the cabinet cover 22 to be coupled with the hook 37.

The door glass 50 has a peripheral edge fixed between the front door frame 32 and the rear door frame 34 to seal the central hole 30*a* of the door frame 30.

Meanwhile, since the design of the product has been recently regarded as an important factor in determining a commodity value of a product in addition to performance and durability of the product, it has become a trend of the drum-type washing machine industry to develop various models considerably focusing on an outer appearance, colors, a texture (that is, appearance and sensation of a surface), and the like of the product when manufacturing a new product in order to satisfy aesthetic desires of consumer.

However, the door of the conventional drum-type washing machine has the door frame 30 formed of the plastic material through the injection molding, and thus, it does not provide a luxurious sensation to the consumer in view of the outer appearance, lowering the commodity value of the product.

Also, high-capacity washing machines are a recent trend of the drum-type washing machine industry, causing the laundry entrance 24 and the door 20 to be enlarged. As a result, the door frame 30 must have a sufficient strength in order to withstand a weight of the enlarged door glass 50. However, since the door frame 30 is formed of the plastic material through the injection molding, it is difficult to secure sufficient strength of the door glass.

In order to solve the problems as described above, it has been suggested to make the door frame 30 from a metallic material which has high strength and permits implementation of a luxurious appearance. However, in this case, there are problems of increasing material costs and a total weight of the door, and of difficulty in surface finishing for enhancing the texture.

SUMMARY OF THE INVENTION

The present invention has been made to solve the above problems, and it is an object of the present invention to provide a door of a drum-type washing machine, which has a front member equipped to a door frame, thereby reinforcing the door frame and allowing easy replacement if necessary, and a method of manufacturing a door having a decorative portion.

It is another object of the present invention to provide a door of a drum-type washing machine, which has a decorative portion formed on a front surface or the front member of the door frame, thereby enhancing the overall aesthetic appearance of the door, and the method of manufacturing the door having the decorative portion.

It is yet another object of the present invention to provide a door of the drum-type washing machine, which has a hairline-shaped decorative portion so as to allow water splashed when withdrawing laundry from the washing machine to remain in the hairline-shaped decorative portion, thereby preventing the front surface of the washing machine from being contaminated and preventing glare on the front surface of the door, and the method of manufacturing the door having the decorative portion.

In accordance with one aspect of the present invention, the above and other objects can be accomplished by the provision of a door of a drum-type washing machine, comprising: a door frame hingeably equipped to a cabinet of the washing machine; a door glass supported by the door frame; and a front member equipped to a front surface of the door frame.

The front member may constitute a decorative portion of the door frame, and the decorative portion may have hairline shapes.

The front member may be equipped to the door frame so as to reinforce the door frame.

The door frame may comprise a non-metallic material, and the front member may comprise a metallic material. Here, the front member may comprise stainless steel.

The front member may have a sheet structure mounted on the front surface of the door frame.

The front surface of the door frame may be formed with a mounting recess which the front member is fitted to and mounted on the front surface of the door frame.

The door frame and the mounting recess may have a circular ring shape, and the front member may also have the circular ring shape so as to be fitted to the mounting recess.

The front member may be mounted to the mounting recess by press fitting.

Alternatively, the front member may be fixed to the door frame by means of a bonding member.

Alternatively, the front member may be fixed to the door frame by means of a fastening member.

The fastening member may comprise latching protrusions formed to one of the door frame and the front member, and latching holes formed to the other so as to be coupled to the latching protrusions, respectively.

The latching protrusions may be protruded on inner and outer surfaces of the mounting recess of the door frame, respectively, and the latching grooves may be formed on inner and outer surfaces of the front member bent to closely contact the inner and outer surfaces of the mounting recess, respectively.

Each of the latching protrusions may have a sloped surface in a direction of the front member being fitted to the mounting recess such that the front member may be easily fitted into the mounting recess.

The front surface of the door frame may have a protective coating formed at least on a surface of the front member.

Alternatively, the front member may be formed as a metal plated layer formed on the front surface of the door frame.

In accordance with another aspect of the present invention, a door of a drum-type washing machine is provided, comprising: a door frame hingeably equipped to a cabinet of the washing machine; a door glass supported by the door frame; and a decorative portion formed on a front surface of the door frame.

The decorative portion may be directly formed on the surface of the door frame, and may have hairline shapes.

The hairline shapes may be formed by scratching the front surface of the door frame.

The front surface of the door frame may be plated with a metallic material at least at a portion where the hairline shapes are formed thereon. In other words, the door frame may comprise a non-metallic material through injection molding and have a metal plated layer at least at the portion where the hairline shapes are formed thereon.

Alternatively, the door frame may have a metal plated layer formed thereon, and the decorative portion may be formed on the metal plated layer.

A protective coating may be formed on the metal plated layer, and may comprise a transparent material having various colors.

The door frame may have a protective coating formed thereon so as to cover at least the decorative portion.

In accordance with yet another aspect of the present invention, a method of manufacturing a door having a decorative portion formed thereon is provided, comprising the steps of: cutting a front member from a metal plate; forming the decorative portion on the front member so as to provide a texture; and coupling the front member to a door frame.

The step of cutting the front member may comprise cutting a plurality of front member pieces from the metal plate, welding the plurality of front member pieces to form a ring-shaped front member, and finishing welded portions of the completed front member.

The front member pieces may be cut from the metal plate to have arc shapes separating the front member with an identical angle.

The decorative portion may have hairline shapes.

At the step of coupling, the front member may be mounted to the door frame by fitting the front member into a seating recess of the door frame, or the front member may be fixed to the door frame by means of a bonding member.

In accordance with still another aspect of the present invention, a method of manufacturing a door having a decorative portion formed thereon is provided, comprising the steps of: forming a pattern of a decorative portion on an injection mold for a door frame such that the decorative portion may be formed on a front surface of the door frame after injection molding; and injection molding the door frame using the injection mold having the pattern of decorative portion formed thereon.

The decorative portion may have hairline shapes.

The pattern of the decorative portion may be formed by photo-etching to a cavity of the injection mold.

The method may further comprise plating the front surface of the door frame with a metallic material after injection molding.

In the door of the drum-type washing machine and the method for manufacturing the same according to the invention, the front member is equipped to the front surface of the door frame, so that the entire structure of the door frame can be reinforced without entirely using a metallic material or a special material.

In particular, when the door frame is reinforced by means of the front member, the door glass can be stably supported by the door frame even though the weight of the door is increased due to increase in size of the door.

Additionally, the decorative portion is formed on the front member of the door frame or directly on the door frame, thereby enhancing the aesthetic appearance of the door.

Additionally, when the decorative portion has the hairline shapes, the hairline-shaped decorative portion allows water splashed during withdrawal of laundry from the washing machine to remain therein, and prevents the water from spreading to other portion on the door frame, thereby preventing the front surface of the washing machine from being contaminated.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments of a door of a drum-type washing machine and a method of manufacturing the door having a decorative portion for the drum-type washing machine will now be described in detail with reference to the accompanying drawings.

Figure 1:
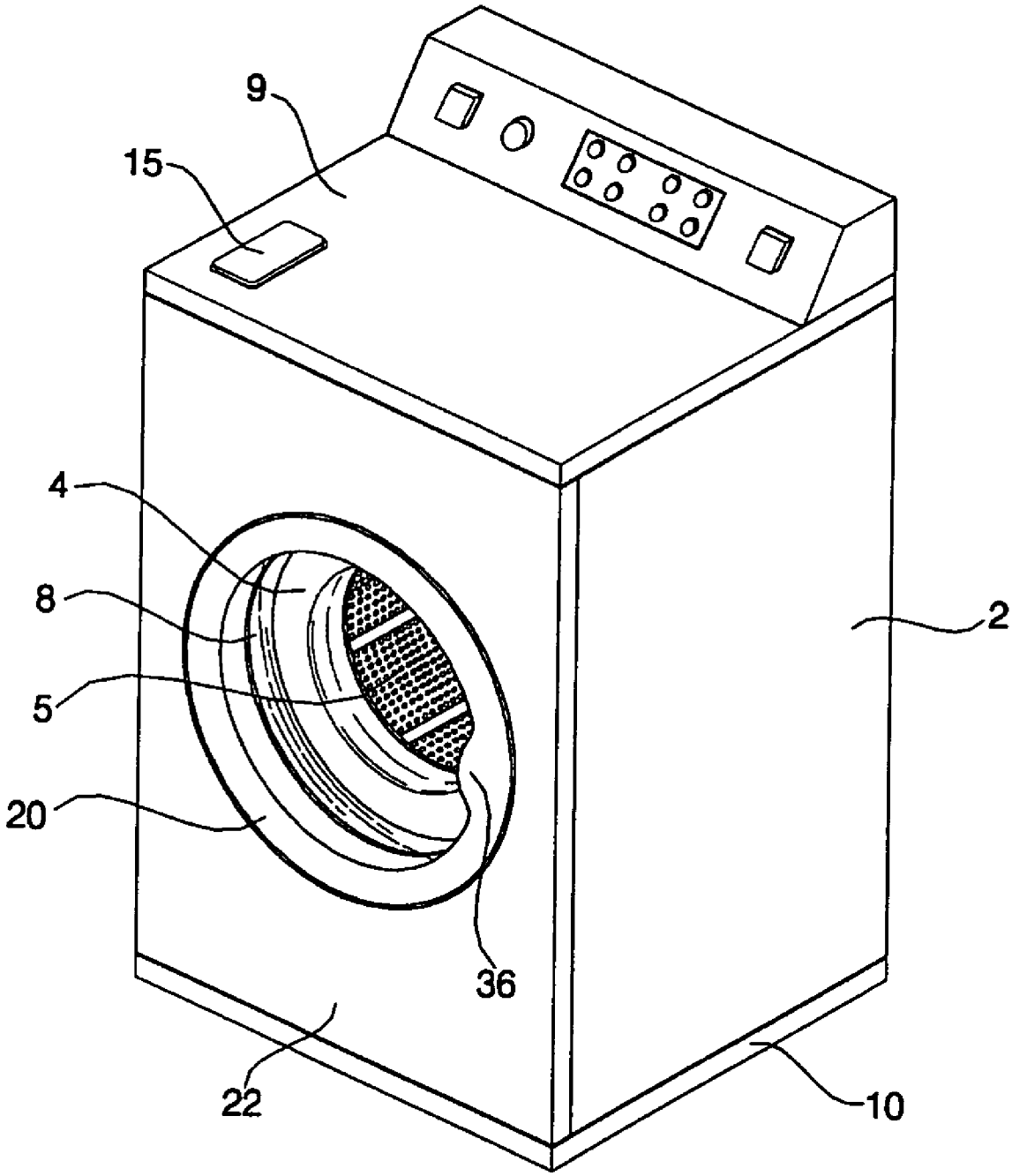
FIG. 1 (Prior Art)
FIG. 1 is a perspective view illustrating a conventional drum-type washing machine.
Figure 2:
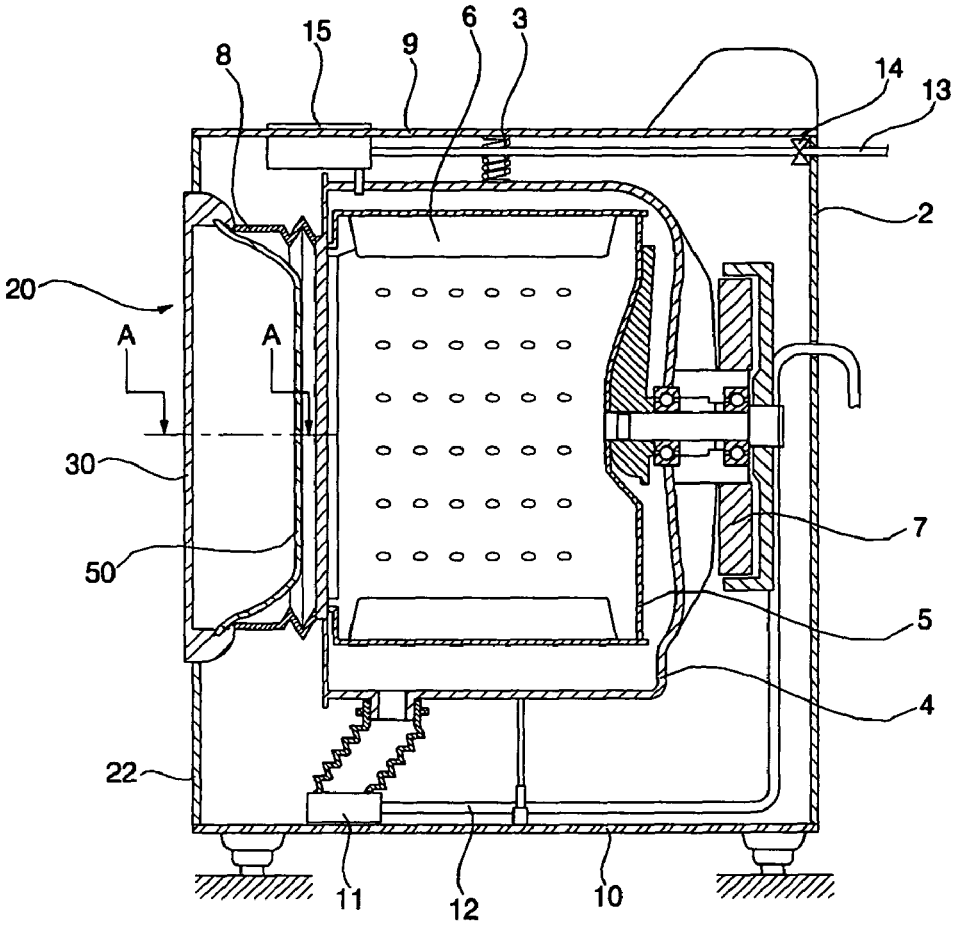
FIG. 2 (Prior Art)
FIG. 2 is a section side elevation illustrating the conventional drum-type washing machine.
Figure 3:
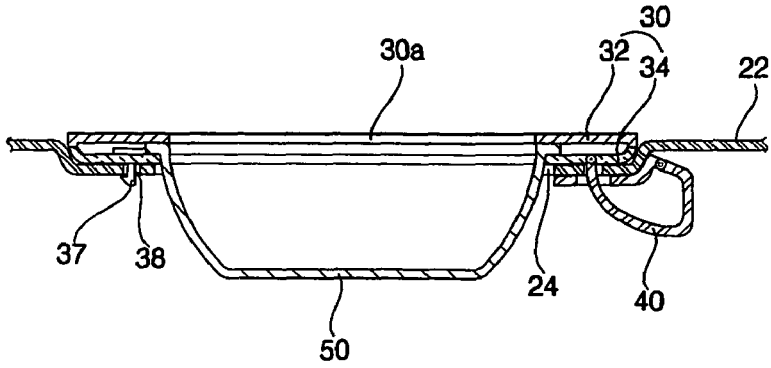
FIG. 3 (Prior Art)
FIG. 3 is a cross-sectional view taken along line A-A of FIG. 2.
Figure 4:
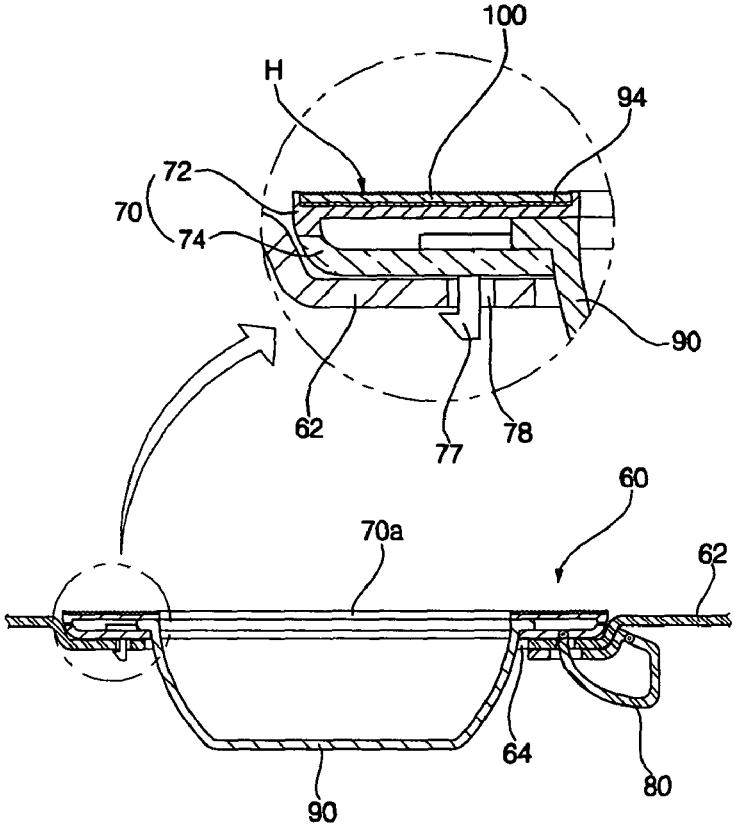
FIG. 4 is a cross-sectional view illustrating a door of a drum-type washing machine according to a first embodiment of the present invention.
Figure 5:
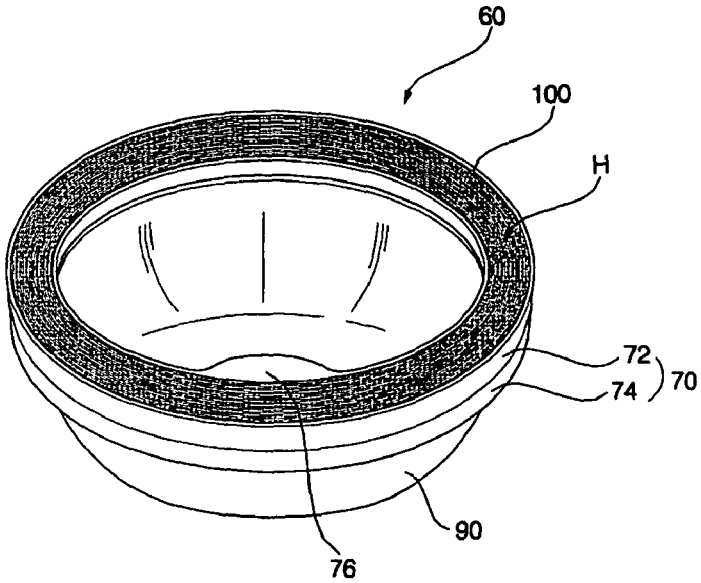
FIG. 5 is a perspective view illustrating the door of the drum-type washing machine according to the first embodiment of the present invention.
Figure 6:
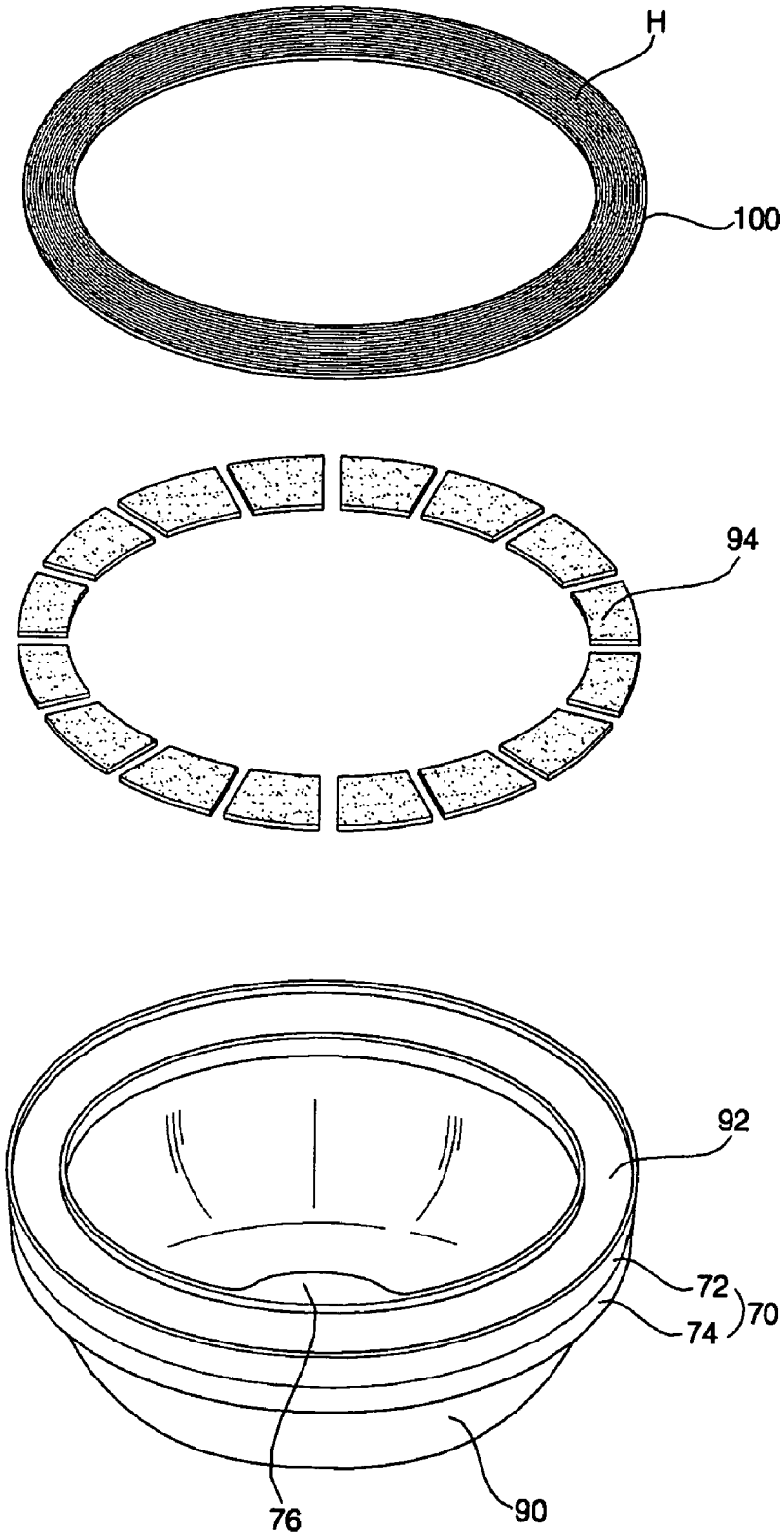
FIG. 6 is an exploded perspective view illustrating the door of the drum-type washing machine according to the first embodiment of the present invention.

FIG. 4 is a cross-sectional view illustrating a door of a drum-type washing machine according to a first embodiment of the present invention, FIG. 5 is a perspective view illustrating the door of the drum-type washing machine according to the first embodiment of the present invention, FIG. 6 is an exploded perspective view illustrating the door of the drum-type washing machine according to the first embodiment of the present invention.

As shown in FIGS. 4 to 6, a door 60 of a drum-type washing machine according to the first embodiment of the invention comprises a ring-shaped door frame 70 hingeably provided to a cabinet cover 62 having a laundry entrance 64 formed through the cabinet cover 62, a door hinge 80 having both ends respectively connected to the door frame 70 and the cabinet cover 62 to hingeably support the door frame 70, a door glass 90 installed at a central hole 70*a* opened through the door frame 70 to allow an inner circumstance of a drum to be observed therethrough, and a front member 100 attached to a front surface of the door frame 70 to impart a luxurious texture to the door 60 and having a sheet structure to reinforce the door frame 70.

The door frame 70 comprises a front door frame 72 provided to the front side of the door frame 70 and having a grip 76 formed at one side of the door frame 70, and a rear door frame 74 provided to the rear side of the front door frame 72 and having one end of the door hinge 80 connected to the rear door frame 74.

The rear door frame 74 has at least one hook 77 protruded at one side thereof, and the cabinet cover 62 has at least one hook hole 78 formed through the cabinet cover 62 at a location corresponding to the hook 77, so that the hook 77 is fitted into the hook hole 78, thereby allowing the door 60 closing the laundry entrance 64 to be fixed thereto.

The front door frame 72 and the rear door frame 74 are preferably formed of a non-metallic material, such as plastics, having excellent injection molding characteristics and being lightweight.

The door glass 90 has a peripheral edge fixed between the front door frame 72 and the rear door frame 74, and seals the central hole 70*a* open through the door frame 70 when the front door frame 72 is coupled to the rear door frame 74.

The front surface of the front member 100 is formed with a decorative portion so as to impart a luxurious texture, and the decorative portion of this embodiment has multiple ring-shaped hairlines H. The front member 100 is fitted into a mounting recess 92 formed on the front surface of the door frame 70, and is then mounted on the door frame 70.

The front door frame 72 has the mounting recess 92 formed on the front surface thereof so as to allow the front member 100 to be fitted thereto. The mounting recess 92 has a ring shape along the front door frame 72.

The front member 100 is a thin ring-shaped panel, and formed of stainless steel. The front member 100 has a plurality of ring-shaped hairlines H formed on the front surface of the front member 100 in order to exhibit the luxurious texture.

Here, the front member 100 may be cut as a complete ring shape from a stainless steel plate. Alternatively, it may be formed by cutting a plurality of separate pieces from the stainless steel plate and then coupling the separate pieces.

The hairlines H consist of very fine lines formed by scratching the front surface of the front member 100 with a sharp tool, and have different radii on the front surface of the ring-shaped front member 100.

Accordingly, the door 60 may not only be reinforced by means of the front member 100 formed of a metallic material, but also have the luxurious texture due to the hairlines H of the front member 100. Of course, in order to enhance the aesthetic appearance of the door 60, the surface of the front door frame 72 is preferably plated with a material similar to that of the front member 100.

The front member 100 constructed as described above is press fitted into the mounting recess 92 of the front door frame 72. Thus, the front member 100 may be manufactured to have a size enabling the front member 100 to be press fitted into the mounting recess 92.

Alternatively, the front member 100 is fixed to the mounting recess 92 of the front door frame 72 by means of a bonding member 94.

Representatively, the bonding member 94 is an adhesive or a double-sided adhesive tape, and is previously disposed on a bottom surface of the mounting recess 92 before the front member 100 is press fitted into the mounting recess 92, thereby bonding the front member 100 to the mounting recess 92.

A method of manufacturing the door having the decorative portion for the drum-type washing machine according to the first embodiment of the invention will now be described hereinafter.

Figure 7:
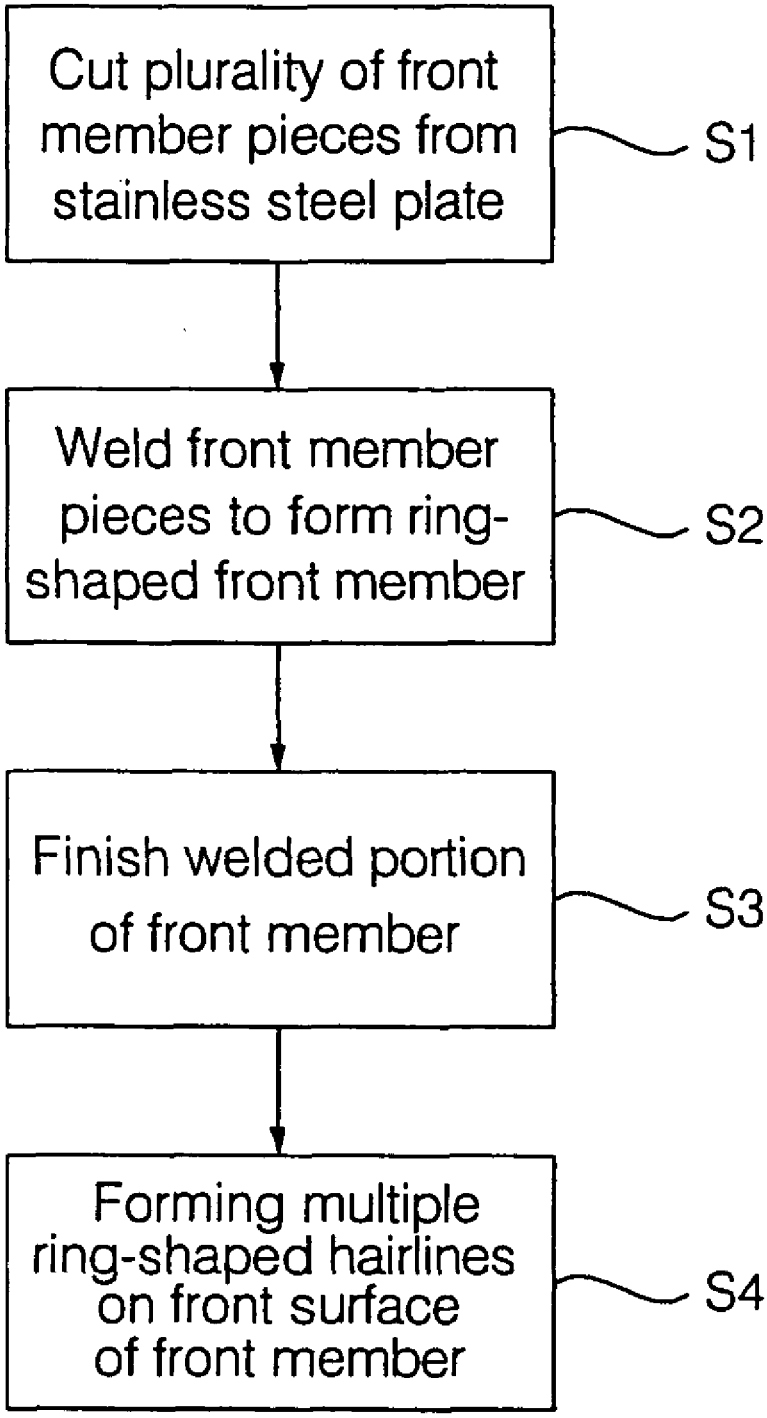
FIG. 7 is a block diagram illustrating a method of manufacturing a front member for the door of the drum-type washing machine according to the first embodiment of the present invention.
Figure 8:
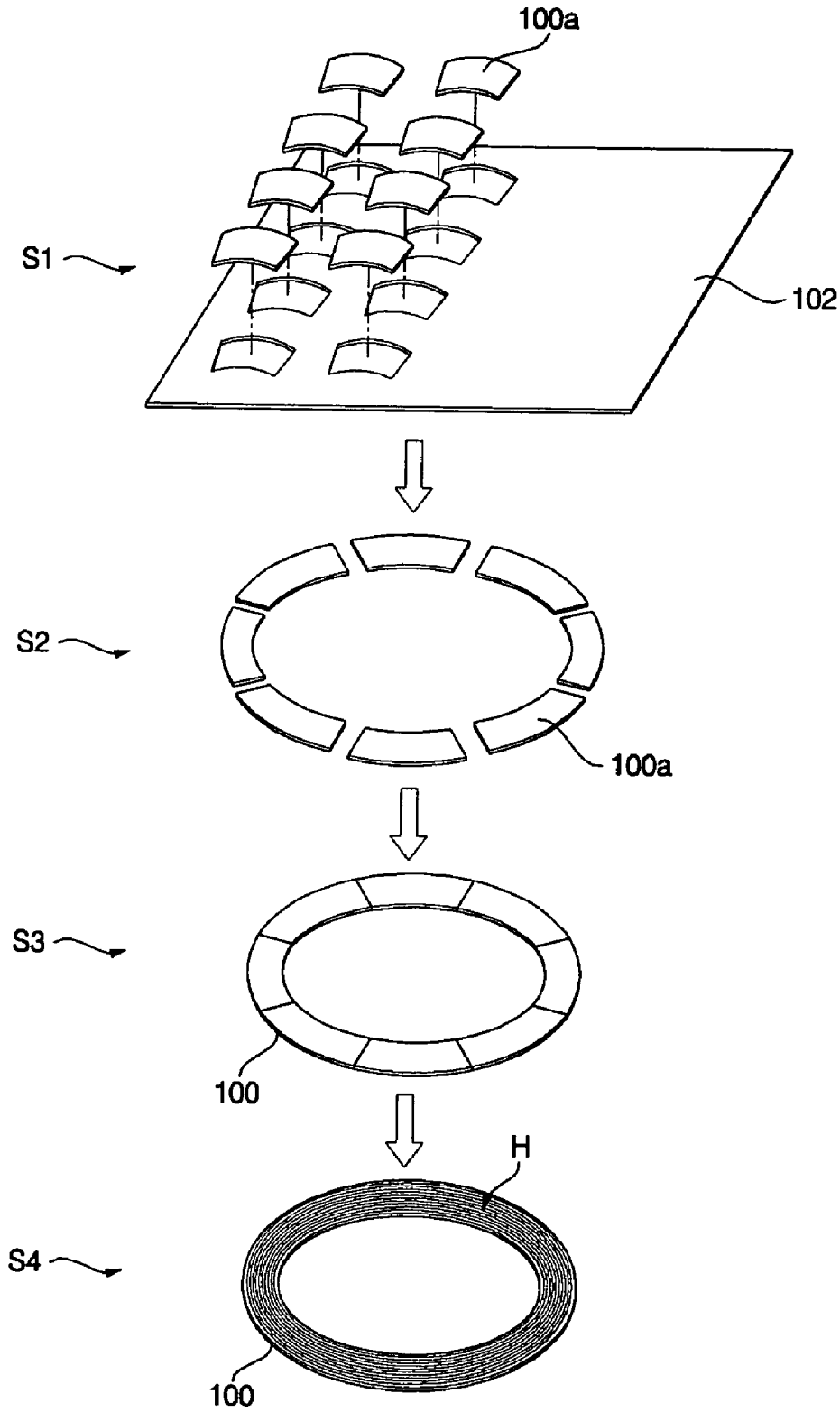
FIG. 8 is a flow diagram illustrating the method of manufacturing the front member for the door of the drum-type washing machine according to the first embodiment of the present invention.

FIG. 7 is a block diagram illustrating a method of manufacturing a front member for the door of the drum-type washing machine according to the first embodiment of the invention, FIG. 8 is a flow diagram illustrating the method of manufacturing the front member for the door of the drum-type washing machine according to the first embodiment.

First, a ring-shaped front member 100 is cut from a stainless steel plate 102, and is then scratched on the front surface thereof by means of a sharp tool such that a plurality of hairlines H having different radii are formed on the front surface of the front member 100 to form a decorative portion.

The front member 100 is processed to have a size allowing the front member 100 to be press fitted into the mounting recess 92 of the front door frame 72. The mounting recess 92 of the door frame 70 has a bottom surface upon which a double-sided adhesive tape 94 is disposed.

That is, as the front member 100 is press fitted into the mounting recess 92, the front member 100 is fixed into the mounting recess 92, and at the same time, the rear side of the front member 100 is bonded and fixed to the bottom surface of the mounting recess 92 by the double-sided adhesive tape 94.

Thus, the front member 100 can be conveniently provided to the door frame 70 only by an operation of fitting the front member 100 into the mounting recess 92.

As the front member 100 is fitted into the mounting recess 92 of the door frame 70 as described above, the door frame 70 is reinforced due to the front member 100 formed of the stainless steel.

As a result, even though the weight of the door glass 90 is increased due to the size of the door 60 according to a recent trend of enlarging the drum-type washing machine, the door frame 70 is reinforced, and thus more stably supports the door glass 90.

Meanwhile, more specifically, according to the method of manufacturing the front member 100 for the door of the drum-type washing machine, as illustrated in FIGS. 7 and 8, at the step of cutting the front member, a plurality of front member pieces 100*a* are cut from the stainless steel plate 102 in order to manufacture the front member 100 (Step S1).

Here, the stainless steel plate 102 is a flat plate member having a predetermined area, and the front member pieces 100*a* are cut from the stainless steel plate 102 by pressing.

The plurality of front member pieces 100*a* have arc shapes having an identical angle, and the complete ring-shaped front member 100 is formed by connecting a predetermined number of front member pieces 100*a*.

That is, the front member pieces 100*a* are constructed such that the front member 100 is divided into a plurality of pieces in the circumferential direction with an identical angle, and are formed to have an identical arc shape of a predetermined angle.

At the step of welding, the front member pieces 100*a* are connected to each other by welding, thereby forming the ring-shaped front member 100 (Step S2).

At this time, the front member pieces 100*a* have both ends joined to each other by welding.

At the finishing step, welded portions of the front member 100 are ground (Step S3).

Accordingly, the front surface of the front member 100 is smoothed, and is then returned to its original color since the portions changed in color due to welding are removed from the front surface of the front member 100.

At the step of forming a hairline texture, the hairlines H are formed on the front surface of the front member 100 ground at the step of finishing (Step S4).

That is, in a state wherein the front door frame 72 is installed to a rotational jig (not shown) and a scratching tool closely contacts the front surface of the front door frame 72 with a predetermined pressure, one of the jig and the scratching tool is rotated, and the front surface of the front door frame 72 is then scratched by the scratching tool, thereby forming the plurality of ring-shaped hairlines H on the front surface of the front member 100.

Accordingly, the method of manufacturing the front member 100 as described above can prevent unnecessary consumption of the stainless steel plate 102 in comparison to a method of directly cutting the ring-shaped front member 100 from the stainless steel plate 102.

Meanwhile, the front member 100 having the hairlines H formed thereon by the method as described above is attached to the door frame 70 using the bonding member 94 as shown in FIG. 6.

Figure 9:
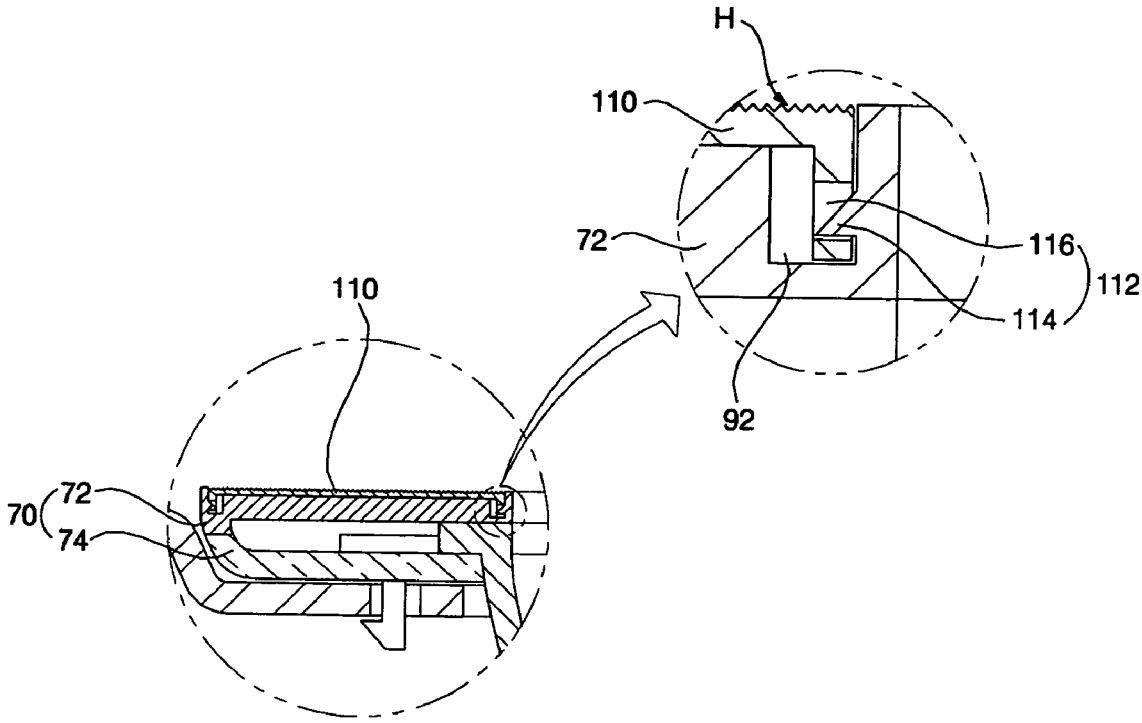
FIG. 9 is a cross-sectional view illustrating a main part in a door of a drum-type washing machine according to a second embodiment of the present invention.
Figure 10:
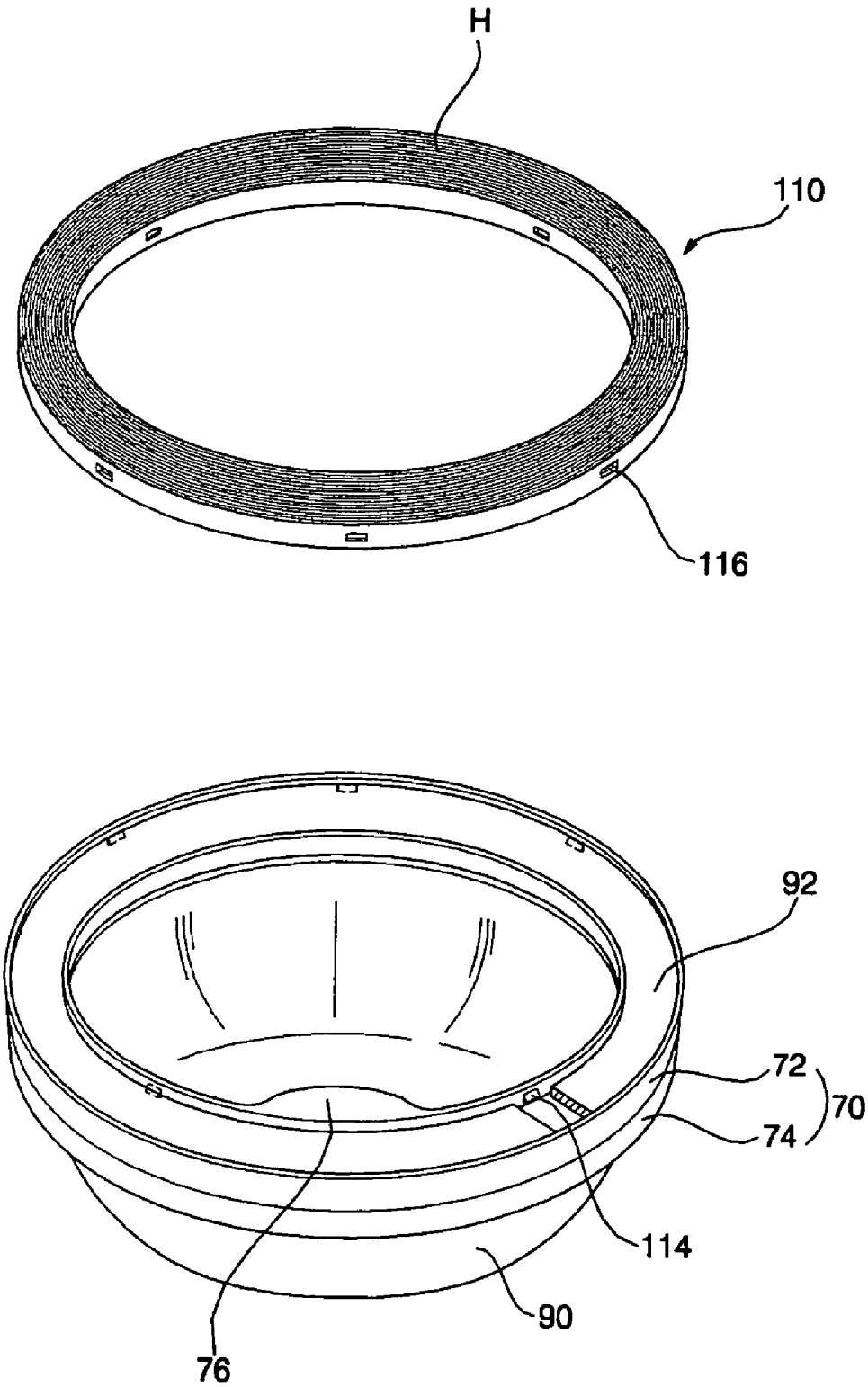
FIG. 10 is a partially cut exploded perspective view illustrating the door of the drum-type washing machine according to the second embodiment of the present invention.
Figure 11A:
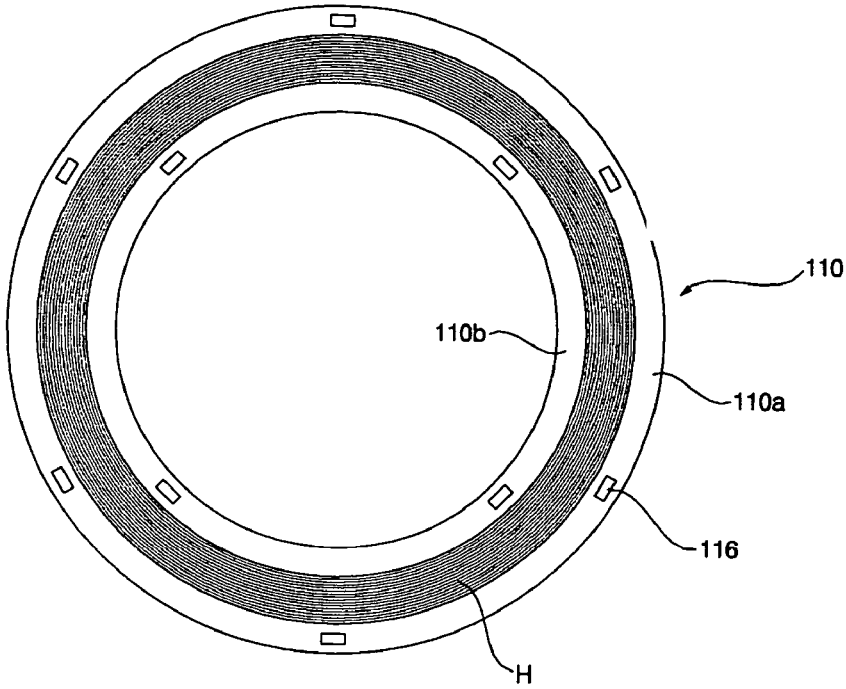
FIG. 11*a* is a plan view illustrating a front member of the door according to the second embodiment of the present invention before the front member is bent.
Figure 11B:
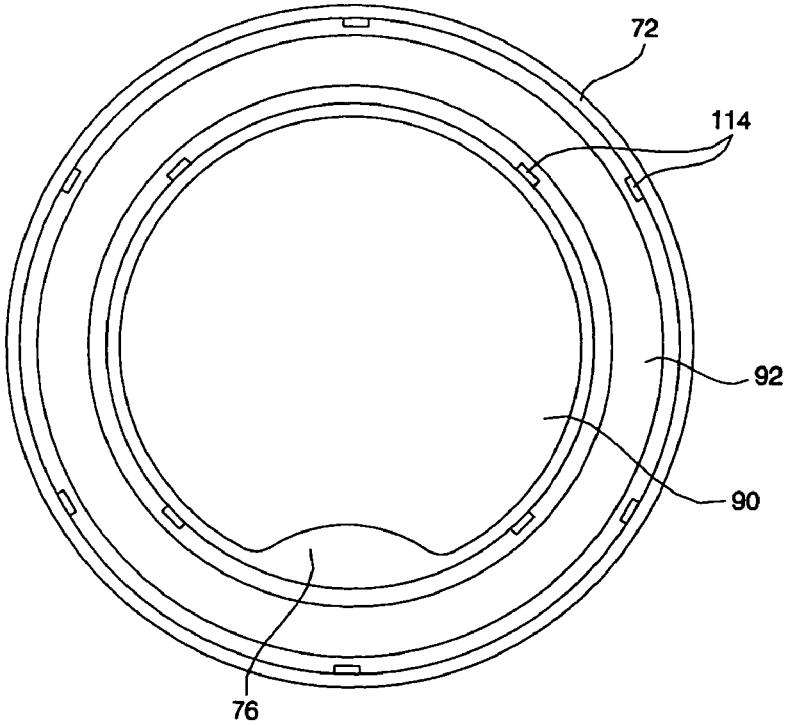
FIG. 11*b* is a plan view illustrating an upper surface of the door according to the second embodiment of the present invention, from which the front member is disassembled.

FIG. 9 is a cross-sectional view illustrating a main part in a door of a drum-type washing machine according to a second embodiment of the invention, FIG. 10 is a partially cutaway exploded perspective view illustrating the door of the drum-type washing machine according to the second embodiment, FIG. 11A is a plan view illustrating a front member of the door according to the second embodiment before the front member is bent, and FIG. 11B is a plan view illustrating an upper surface of the door according to the second embodiment, from which the front member is detached.

For reference, structures the same as or similar to those of the first embodiment will be referred to by the same reference numerals as those of the first embodiment, and a detailed description thereof will be omitted.

As shown in FIGS. 9 to 11A and 11B, the door of the drum-type washing machine according to the second embodiment has the same construction as that of the first embodiment, except for hairlines H formed on a front surface of a door frame 70, and a front member 110 fixed to a mounting recess 92 formed on the front surface of the door frame 70 by means of a fastening member 112.

The fastening member 112 has latching protrusions 114 formed to the mounting recess 92, and latching holes 116 formed to the front member 110 to allow the latching protrusions 114 to be fitted and latched to the latching holes 116, respectively.

The latching grooves 116 are formed on an inner peripheral surface 110*a* and an outer peripheral surface 110*b* of the front member 110, which are bent downwardly to closely contact both inner and outer surfaces of the mounting recess 92, respectively.

Thus, when the front member 110 is fitted into the mounting recess 92, the latching protrusions 114 are fitted and latched to the latching holes 116, thereby allowing the front member 110 to be fixed to the mounting recess 92.

At this time, the front member 110 has a U-shaped cross section, and the mounting recess 92 is depressed corresponding to the front member 110, thereby providing a U-shaped cross section. Accordingly, the front member 110 can be more stably seated into the mounting recess 92.

Each of the latching protrusion 114 has a sloped surface formed thereon in a direction of front member 110 being fitted into the mounting recess 92, thereby allowing the front member 110 to be easily fitted into the mounting recess 92 while it does not have the sloped surface in the direction of the front member 110 being detached from the mounting recess 92, thereby preventing the front member 110 from being unintentionally released from the mounting recess 92.

The latching holes 116 correspond to the latching protrusions 114, and a plurality of latching holes 116 and latching protrusions 114 are formed on the front member 110 and the mounting recess 92 in the circumferential direction to be spaced a predetermined distance from each other, respectively.

A method of manufacturing the door having a decorative portion of the drum-type washing machine according to the second embodiment of the present invention will be described hereinafter.

First, a ring-shaped front member 110 is cut from a stainless steel plate 102 to have a predetermined size, and then the front surface thereof is scratched by means of a sharp tool, such that a plurality of hairlines H having different radii are formed on the front surface of the front member.

Additionally, the front member 110 has an inner peripheral surface 110*a* and an outer peripheral surface 110*b* extending to each other, and a plurality of latching holes 116 are formed on the inner peripheral surface 110*a* and the outer peripheral surface 110*b*, respectively, while being spaced from each other in the circumferential direction.

The inner and outer peripheral surfaces 110*a* and 110*b* of the front member 110 having the latching grooves 116 formed thereon are bent downwardly at portions where the hairlines H are not formed, such that the inner and outer peripheral surfaces 110*a* and 110*b* closely contact the inner and outer surfaces of the mounting groove 92, respectively, upon mounting the front member 110 into the mounting recess 92 of the door frame 70.

That is, when the front member 110 is fitted into the mounting recess 92 of the door frame 70, bent portions of the front member 110 closely contact the inner and outer surfaces of the mounting recess 92, so that the latching protrusions 114 of the mounting recess 92 are fitted and latched to the latching grooves 116.

At this time, each of the latching protrusions 114 has a sloped surface in the direction of the front member 110 being fitted into the mounting recess 92, thereby allowing the front member 110 to be easily fitted into the mounting recess 92, while it does not have the sloped surface in the direction of the front member 110 being detached from the mounting recess 92, thereby preventing the front member 110 from being unintentionally released from the mounting recess 92.

Accordingly, the front member 110 can be conveniently mounted on the front surface of the door in such a manner that, after the hairlines H and the latching holes 116 are formed on the front member 110, the front member 110 with the inner and outer peripheral surfaces 110*a* and 110*b* bent downwardly is fitted into the mounting recess 92 of the door frame 70.

Meanwhile, since other details of the method of manufacturing the door having the decorative portion for the drum-type washing machine are the same as those of the first embodiment, a detailed description thereof will be omitted.

Figure 12:
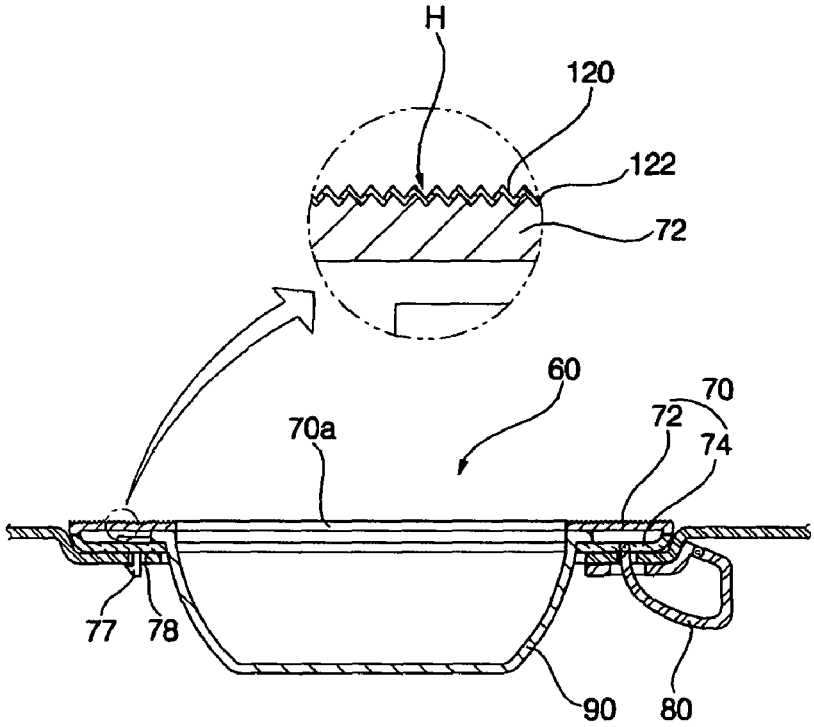
FIG. 12 is a cross-sectional view illustrating a door of a drum-type washing machine according to a third embodiment of the present invention.
Figure 13:
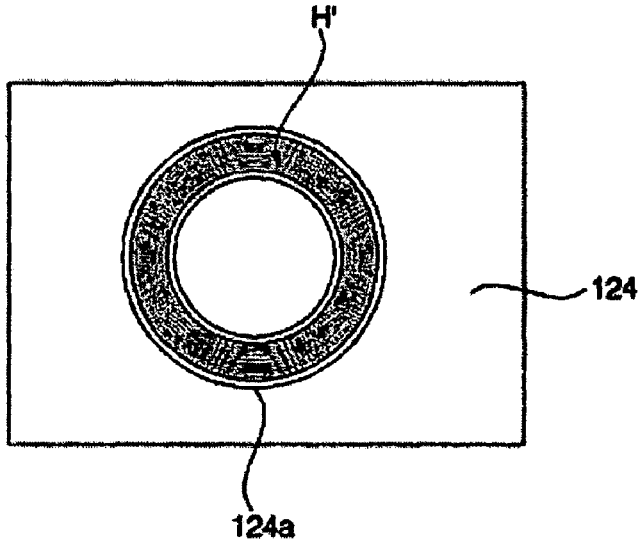
FIG. 13 is a plan view illustrating the interior of an injection mold for a door frame of the door according to the third embodiment of the present invention.

FIG. 12 is a cross-sectional view illustrating a door of a drum-type washing machine according to a third embodiment of the invention, and FIG. 13 is a plan view illustrating the interior of an injection mold for a door frame of the door according to the third embodiment.

For reference, structures the same as or similar to those of the first embodiment will be referred to by the same reference numerals as those of the first embodiment, and a detailed description thereof will be omitted.

As shown in FIGS. 12 and 13, the door of the drum-type washing machine according to the third embodiment has the same construction as that of the first embodiment, except for a decorative portion 120 integrally formed to a front surface of a door frame 70 and plated with a metallic material.

The decorative portion 120 consists of multiple ring-shaped hairlines H formed on the front surface of the front door frame 72, and is integrally formed to the front surface of the front door frame 72 concurrently when injection molding the front door frame 72.

That is, as shown in FIG. 13, an injection mold 124 of the front door frame 72 has a pattern of hairlines H' formed on a cavity 124*a* constituting the front surface of the front door frame 72, so that, as the front door frame 72 is injected by use of the injection mold 124, the front door frame 72 is formed on the front surface with hairlines H corresponding to the pattern of hairlines H' of the injection mold 124.

A chrome-plated layer is formed on the front door frame 72 where the hairlines H are formed.

A method of manufacturing the door having the decorative portion for the drum-type washing machine according to the third embodiment will be described hereinafter.

Figure 14:
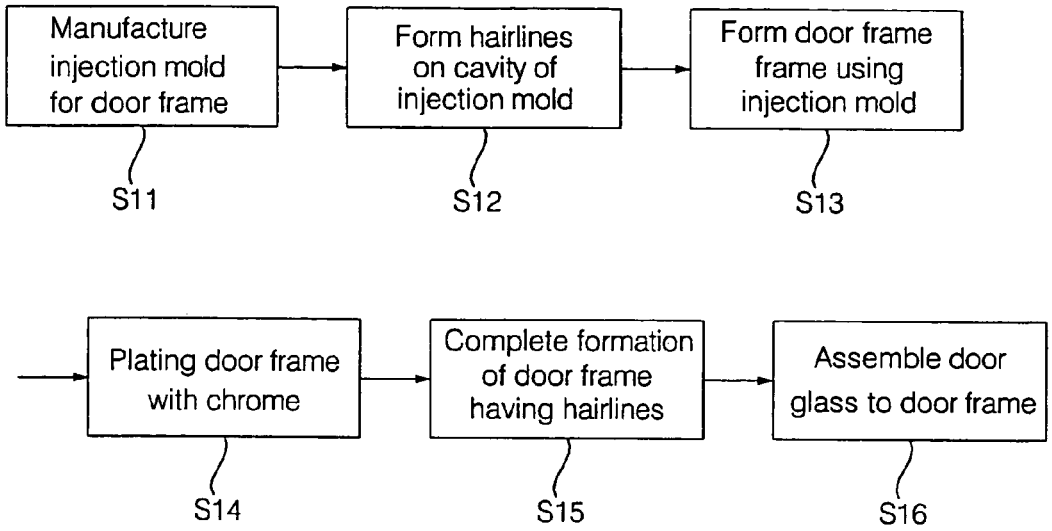
FIG. 14 is a block diagram illustrating a method of manufacturing the door having the decorative portion according to the third embodiment of the present invention.

FIG. 14 is a block diagram illustrating a method of manufacturing the door having the decorative portion according to the third embodiment of the invention.

First, at the step of forming a hairline texture, an injection mold 124 for a front door frame 72 is formed with a pattern of hairlines H' in order to form hairlines H on a front surface of the front door frame 72 upon injection molding the front door frame 72 (Steps S11 and S12).

That is, a pattern of hairlines H' is formed on a cavity 124*a* of the injection mold 124 for the front door frame 72 by an etching process. Such an etching process for forming the pattern of hairlines H' on the cavity 124*a* of the injection mold 124 includes a general photo-etching process.

At the step of injection molding, the front door frame 72 is injection molded by use of the injection mold 124 having the pattern of hairlines H' formed at the step of forming the hairline texture (Step S13).

Accordingly, with the hairlines H integrally formed on the front surface of the front door frame 72, the front door frame 72 can be injection molded using the injection mold 124. As for a casting material for the door frame 70, a plastic material can be used due to its lower specific weight and strength of a predetermined level as well as excellent injection molding characteristics.

At the step of plating, an outer surface of the front door frame 72 injection molded at the step of injection molding is plated with a metallic material in order to impart a more luxurious appearance to the drum-type washing machine (Steps S14 and S15).

As for a plating material, chrome can be generally used, since it has an excellent wear resistance and provides a superior appearance. As such, the front door frame 72 exhibits a metallic luster due to a chrome plated layer 122 formed on the front surface of the front door frame 72, thereby providing a luxurious texture to the door of the drum-type washing machine in comparison to the door having a synthetic resin surface.

Accordingly, the door 60 of the drum-type washing machine has the decorative portion formed on the front surface of the door frame 70 and is plated on the outer surface thereof with chrome, thereby providing a luxurious appearance to the door 60.

Thereafter, the door glass 90 is assembled to the central hole 70*a* of the door frame 72 configured as described above, thereby completing the door 60 (Step S16).

Figure 15:
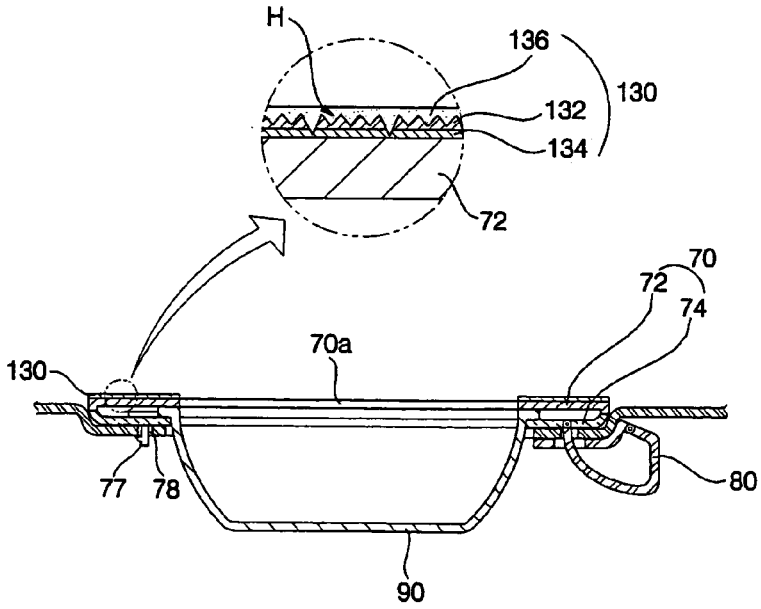
FIG. 15 is a cross-sectional view illustrating a door of a drum-type washing machine according to a fourth embodiment of the present invention.

FIG. 15 is a cross-sectional view illustrating a door of a drum-type washing machine according to a fourth embodiment of the invention.

For reference, structures the same as or similar to those of the first embodiment will be referred to by the same reference numerals as those of the first embodiment, and a detailed description thereof will be omitted.

As shown in FIG. 15, the door of the drum-type washing machine according to the fourth embodiment of the invention has the same construction as that of the first embodiment, except for a decorative portion 130 comprising multiple ring-shaped hairlines H formed on an outer surface of a front door frame 70 in such a manner that the hairlines H are directly formed on a front surface of the door frame 70 by a scratching process.

The decorative portion 130 consists of the multiple ring-shaped hairlines H formed on the front surface of a front door frame 72 by the scratching process. At this time, since the front surface of the front door frame 72 is plated with chrome to form a chrome-plated layer 132, the multiple ring-shaped hairlines H are formed on the chrome-plated layer 132.

Meanwhile, when the hairlines H are formed on the front surface of the front door frame 72 by scratching, a protective coating 136 is formed on the front surface of the front door frame 72 to protect the hairlines H.

The protective coating 136 is formed of transparent materials in order to allow the hairlines H to be observed therethrough, and the color and luster of the protective coating 136 can be selected according to a fondness or style of a user.

A method of manufacturing the door having the decorative portion for the drum-type washing machine according to the fourth embodiment of the invention will now be described hereinafter.

Figure 16:
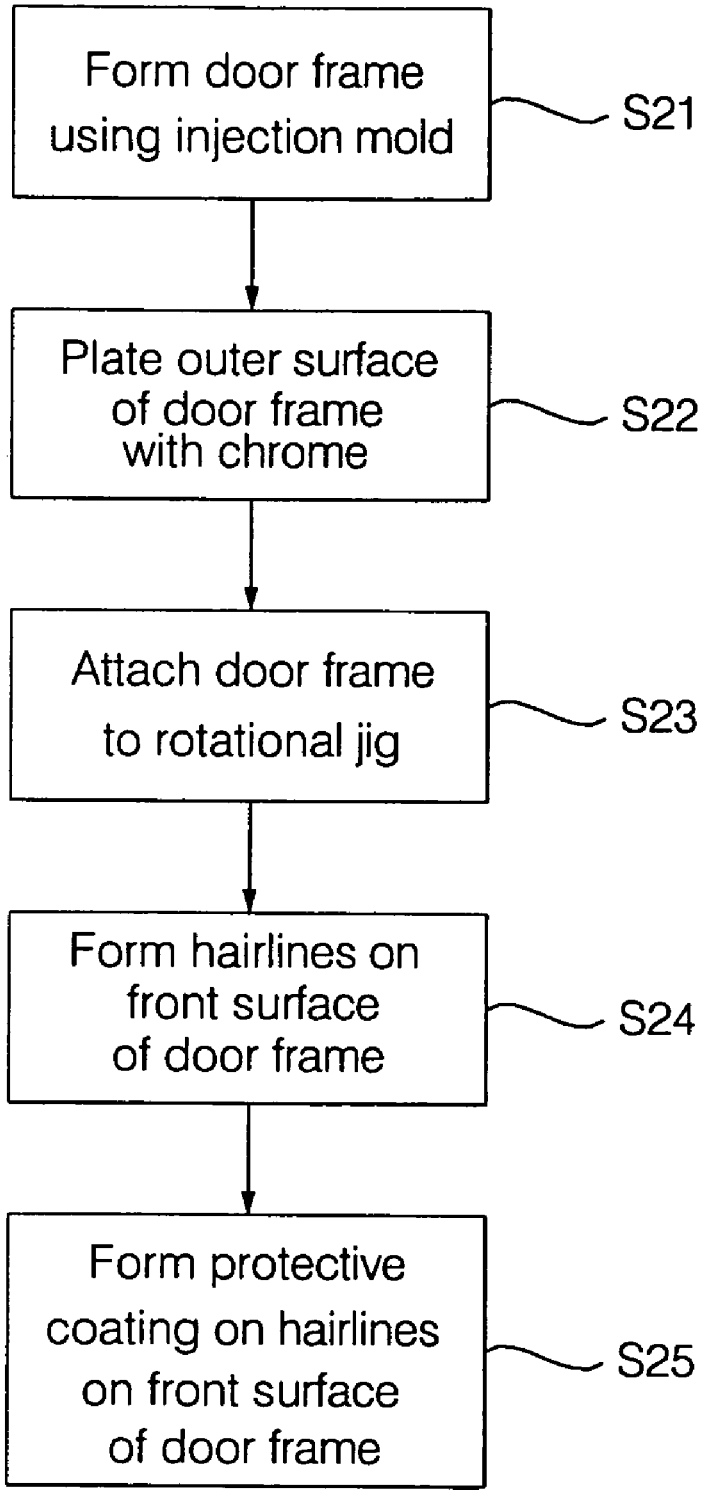
FIG. 16 is a block diagram illustrating a method of manufacturing a door having a decorative portion according to the fourth embodiment of the present invention.

FIG. 16 is a block diagram illustrating a method of manufacturing a door having a decorative portion according to the fourth embodiment of the present invention.

First, at the step of plating, the door frame 70 formed of the plastic material by means of the injection molding is plated with a metallic material, thereby enhancing a texture of the door 60 (Steps S21 and S22).

That is, the door 60 is plated with the metallic material on the front door frame 72 of the door frame 70 in order to prevent an aesthetic outer appearance of the door frame 70 from being deteriorated due to the texture of the plastic material of the door frame 70. As for a plating material, chrome can be generally used, since it has an excellent wear resistance and provides a pleasant texture to consumers.

At the step of forming the hairline texture, the luxurious texture is imparted to the front surface of the front door frame 72 plated at the step of plating by means of the scratching process (Steps S23 and S24).

More specifically, in a state wherein the front door frame 72 is provided to a rotational jig (not shown) and a tool for the scratching process closely contacts the front surface of the front door frame 72, one of the jig and the scratching tool is rotated, causing the chrome plated layer 132 of the front door frame 72 to be scratched by the tool, thereby forming a plurality of ring-shaped hairlines H.

The front appearance of the door 60 is imparted with the luxurious texture due to the hairlines H processed as described above, thereby enhancing the commodity value of the washing machine.

At the step of coating, a protective coating is coated on the front surface of the front door frame 72 subjected to the scratching process at the step of forming the texture in order to prevent corrosion and damage of the decorative portion 130 (Step S25).

Here, although chrome used for plating of the front door frame 72 provides excellent texture and stiffness, it has a problem with lower attachment to the surface of the plastic material. Accordingly, after copper is previously plated on the surface of the front door frame 72, chrome is plated on the copper plated layer 134.

That is, after the plastic material of the front door frame 72 is previously plated with copper, which has a relatively good plating capability, forming the copper plated layer 134 on the outer surface of the front door frame 72, chrome is plated on the copper plated layer 134, thereby forming the chrome plated layer 132.

At this time, as the scratching process is applied to the front door frame 72 at the step of forming the texture in order to form the hairlines H, the chrome plated layer 132 is peeled off, and some portion of the copper plated layer 134 is then exposed to the outside. In this regard, since copper is a metal easily subjected to corrosion unlike chrome, the copper plated layer 134 exposed to the outside by the scratching process can be easily corroded, whereby the outer appearance of the door can be deteriorated rather than improved.

In order to prevent the door frame 70 from being corroded as described above, the front surface of the front door frame 72 where the hairlines H are formed is coated with the corrosion resistant protective coating 136.

The protective coating 136 also prevents the hairlines H formed via the scratching process from being destroyed or damaged due to impact, and the consumers from being injured by the sharply scratched hairlines H.

Meanwhile, the protective coating 136 is formed of transparent materials, so that the luxurious feeling of the door 60 imparted due to plating of chrome and the hairlines H can be suitably provided to the consumers in view of visibility.

Since the color and luster of such a protective coating 136 can be selected according to the materials and methods of coating, the texture can be appropriately imparted to the front surface of the front door frame 70 depending on the application thereof.

As apparent from the description, according to the present invention, the door of the drum-type washing machine and the method of manufacturing the same provide the front member equipped to the front surface of the door frame, thereby entirely reinforcing the door without entirely using a metallic material or a special material.

In particular, when the door frame is reinforced by means of the front member, the door frame can stably support the door glass even though the weight of the door is increased due to increase in size of the door.

Additionally, the decorative portion is formed on the front member of the door frame or directly on the door frame, thereby enhancing the aesthetic appearance of the door.

Additionally, when the decorative portion has the hairline shapes, the hairline-shaped decorative portion allows water splashed during withdrawal of laundry from the washing machine to remain therein, and prevents the water from spreading to other portion on the door frame, thereby preventing the front surface of the washing machine from being contaminated.

Additionally, since the hairline portion reflects or absorbs light, it protects against glare due to a metal-plated layer formed on the surface of the door frame, thereby reducing inconvenience of the user.

Additionally, the decorative portion enhances the aesthetic appearance of the door, and provides a luxurious appearance to the washing machine, thereby satisfying the aesthetic desires of the consumer and enhancing the commodity value of the drum-type washing machine.

Additionally, as the door of the drum-type washing machine and the method of manufacturing the door according to the first and second embodiments of the invention have the stainless steel front member fixed to the mounting recess, which is formed on the front surface of the door frame, the front member can be conveniently mounted on the front surface of the door frame only with a simple operation of fitting the front member into the mounting recess of the door frame, and, even though the surface of the door is severely damaged or contaminated, these can be conveniently overcome by replacing the damaged or contaminated front member with a new one.

Additionally, according to the first and second embodiments of the invention, the method of manufacturing the front member used for the door comprises the steps of cutting the plurality of front member pieces from the stainless steel plate, welding them to each other to form the front member, and finishing the welded portions of the front member, followed by forming the multiple ring-shaped hairlines, thereby preventing unnecessary consumption of the stainless steel plate and reducing manufacturing costs and a price of the product, resulting in enhancement of price competitiveness, in comparison to the method of directly cutting the ring-shaped front member from the stainless steel plate.

Additionally, according to the third embodiment of the invention, the door frame is formed of the plastic material using the injection mold having the pattern of hairlines formed thereon by the photo-etching process to have the decorative portion on the front surface thereof, and is then plated on an outer surface thereof with chrome, thereby simplifying the manufacturing process of the door frame having the decorative portion, and enhancing the productivity.

Additionally, according to the fourth embodiment of the invention, the decorative portion for imparting a luxurious texture to the door of the drum-type washing machine is formed on the front surface of the door in such a manner that the surface of the chrome plated door is scratched using the sharp tool so as to form hairlines on the front surface of the door, and then a transparent and protective coating is formed on the hairlines, whereby the protective coating prevents corrosion of the decorative portion scratched on the door.

Additionally, the protective coating prevents the hairlines from being damaged due to an external impact, and the color and luster of the protective coating can be selected according to the fondness of the user, thereby allowing the outer appearance to be adapted in various shapes.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A door of a drum-type washing machine, comprising:

a ring-shaped door frame configured to be hingeably attached to a cabinet of the washing machine;

a mounting recess formed at a front side of the door frame;

an outer rim and an inner rim of the front side of the door frame protruded from a front surface of the mounting recess;

a door glass supported by the door frame; and a hairline steel member fixed on the front surface of the mounting recess, positioned between the outer and inner rims, and having hairline shapes.

2. The door of claim 1, further comprising:

a first groove formed in the mounting recess proximate the outer rim;

a second groove formed in the mounting recess proximate the inner rim;

a first flange depending from an outer periphery of the hairline steel member, the first flange fitting within the first groove; and a second flange depending from an inner periphery of the hairline steel member, the second flange fitting within the second groove.

3. The door of claim 2, further comprising:

apertures in the first flange and the second flange; and latching protrusions extending into the first groove and the second groove, the latching protrusions engaging the apertures when the first flange and second flange fit within the first groove and second groove, respectively.

4. The door of claim 3, wherein top surfaces of the latching protrusions are sloped.

5. The door of claim 3, wherein latching protrusions in the first groove extend radially inwardly and latching protrusions in the second groove extend radially outwardly.

* * * * *